US007082188B2

(12) United States Patent
Deuringer

(10) Patent No.: US 7,082,188 B2
(45) Date of Patent: Jul. 25, 2006

(54) POWER SOURCE FOR REGULATED OPERATION OF THE DEFLECTION COIL OF AN X-RAY TUBE

(75) Inventor: Josef Deuringer, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 133 days.

(21) Appl. No.: 10/757,277

(22) Filed: Jan. 14, 2004

(65) Prior Publication Data

US 2004/0208287 A1 Oct. 21, 2004

(30) Foreign Application Priority Data

Jan. 14, 2003 (DE) ..... 103 01 068

(51) Int. Cl.
*H05G 1/52* (2006.01)

(52) U.S. Cl. ..... 378/113; 378/137

(58) Field of Classification Search ..... 378/113, 378/137, 101; 315/383, 387, 394, 397, 399
See application file for complete search history.

(56) References Cited

U.S. PATENT DOCUMENTS 4,104,567 A * 8/1978 Peer et al. ..... 315/387
6,002,453 A * 12/1999 Van Tuijl et al. ..... 348/805

FOREIGN PATENT DOCUMENTS

EP 0 374 289 A1 6/1990

* cited by examiner

*Primary Examiner*—Edward J. Glick
*Assistant Examiner*—Jurie Yun
(74) *Attorney, Agent, or Firm*—Schiff Hardin LLP

(57) ABSTRACT

A power source for the operation of a deflection coil for an electron beam of an x-ray tube has a voltage source and a bridge circuit that is connected with each end of the deflection coil, respectively via one power switch in series connection to opposite poles of the voltage source. A current tap taps a coil current signal proportional to the current through the deflection coil. An activation comparator and a deactivation comparator are connected with the current tap to which an activation current signal $I_{min}$ and a deactivation current signal $I_{max}$ are supplied. The power switches are connected with the activation comparator and deactivation comparator such that they are closed in the event that the coil current signal undershoots the activation current signal $I_{min}$ and opened in the event that the coil current signal overshoots the deactivation current signal $I_{max}$.

7 Claims, 3 Drawing Sheets

POWER SOURCE FOR REGULATED OPERATION OF THE DEFLECTION COIL OF AN X-RAY TUBE

BACKGROUND OF THE INVENTION

1. Field of the Invention

The present invention concerns a power source for operation of a deflection coil for an electron beam of an x-ray tube. The power source is of the type having a voltage source and a bridge circuit that is connected with each end of the deflection coil via, at each end, one power switch in series connection with opposite poles of the voltage source.

2. Description of the Prior Art

In x-ray devices, x-ray tubes are used to generate x-ray radiation. In the x-ray tube, electrons are accelerated by an electric field, at the x-ray voltage, from a cathode to an anode. Upon striking the anode, the electrons generate characteristic x-ray radiation as a result of their kinetic energy. The direction and form of the generated x-ray beam are determined by the condition and alignment of the surface of the anode as well as by the direction and focal spot contour of the electron beam striking on the anode. In order to generate a directed and intensive x-ray beam in the desired direction, the electron beam is focused and directed at a specific location of the anode surface.

The anode is significantly heated by the kinetic energy of the incident electrons. The electron beam therefore is not statically focused at a point, but rather is oscillated within a specific region in order to enlarge the focal spot on the anode surface and to better distribute the thermal load. The properties of the x-ray beam furthermore can be selectively influenced dependent on the size and contour of the focal spot. In addition to this, there are diagnostic applications In which, simultaneously or in the shortest possible temporal succession, x-ray beams are required from two different directions. Such x-ray beams can be generated by one and the same x-ray tube, by moving the electron beam back and forth in rapid temporal succession between two different focal spots on the anode surface. The movement of the electron beam over the anode surface can be accomplished by a deflection using electromagnetic fields.

Although electrical fields also are used to focus the electron beam, the deflection predominantly occurs using magnetic fields. These are generated by deflection coils that are arranged around the electron beam between cathode and anode, Depending on the requirements for the sharpness of the focusing, the complexity of the focal spot shape, and the desired freedom for deflection of the electron beam, one or more deflection coils can be provided.

The magnetic field generated by the coils is varied by the coil current. The change of the focal spot contour by the movement of the electron beam thus is effected by changing the coil current. The back-and-forth movement of the electron beam between two separate focal spots or different focal spot shapes also is effected by somewhat complex and rapidly ensuing variations of the current in the deflection coils. For this, the coil current must be modified, given changes of the x-ray voltage that accelerates the electrons from the cathode to the anode of the x-ray tube, in order to achieve the retention of the focal spot position; the coil current thus is varied, dependent on the x-ray voltage.

To generate the varying coil current, a power source is necessary that can track the x-ray voltage sufficiently fast enough for modifying the current. The current must be generated in sufficiently precise amounts in order to ensure a stable focal spot position, and it must be exactly variable for generation of the focal spot size an shape. Moreover, tolerances of the x-ray tube or the x-ray voltage must be correctable by a disturbance variable compensation or regulation of the coil current, and a suitable behavior of the power source given failures of the x-ray voltage as a result of tube arcings must be ensured. Not least, the power source should be as small as possible with regard to application in computed tomography (in which it rotates around the examination subject with high rotation speed together with the x-ray tube) and should exhibit a high efficiency to reduce the heat load.

It is known to generate the coil current by means of classical power supply technologies. However, the inductive transformation in power supplies does not allow sufficiently fast modulation of the current. It is additionally known to produce the coil current by means of a function generator and subsequently connected power amplifiers with superimposed current regulation. However, this assembly requires a large structural volume. Moreover, power amplifiers operate with too low an efficiency for the applications described above, Furthermore, the current cannot be regulated with a sufficient stability given large inductive loads (as the deflection coils are) due to their self-induction.

A power source is known from European Application 0 374 289 that is based on the use of power switches. The deflection coil is switched via a bridge circuit of four power switches. To activate the deflection coils, respectively two power switches arranged across from each other are opened, and the deflection coil thus is supplied with a supply voltage. This arrangement enables sufficiently fast switch times in order to ensure a sufficiently fast variation of the coil current, however, the quantity to be varied, the coil current, is not taken into account in the activation of the power switches. A control of the coil current is thereby provided. A control offers no protection against malfunctions as a result of induction-dependent overswings or other interfering influences. Moreover, the circuit does not suitably react given the occurrence of a failure of the x-ray voltage as a result of tube arcings.

SUMMARY OF THE INVENTION

An object of the present invention is to provide a power source for operation of the deflection coils of an x-ray tube that ensures a fast and exact generation of the coil current given simultaneously high efficiency. It is a further object of the invention to provide a power source for operation of an x-ray tube that enables a largely interference-proof regulation of the coil current.

These objects are achieved in accordance with the invention by a power source using power switches, by means of which the coil current is not controlled but rather is regulated. As used herein, "regulated" and "regulation" mean the use of closed-loop control. Such regulation offers the advantage that both typical interfering influences (for example, such as the inductance of the deflection coils) and atypical interfering influences (such as oscillations of the supply voltage) are automatically compensated. This is in particular advantageous with regard to irregular or unexpectedly occurring interferences. Moreover, the regulation of the coil current is also advantageous because with the coil current, a quantity causally linked with the deflection of the electron beam of the x-ray tube, is used, and rather than a quantity in arbitrarily indirect association with the deflection. The assembly with power switches, moreover, offers the advantage of fast switch times; additionally it involves a smaller overall size and a higher efficiency, which also enables the use of the power source in computed tomography.

In an advantageous embodiment of the invention typical interference signals are suppressed, within the regulation circuit of the power source that, for example, can occur as a result of the resonant frequency of the inductance of the deflection coil. This interference suppression offers the advantage that system-typical interfering influences are not additionally amplified by the positive feedback of the regulation circuit.

In a further embodiment of the invention the power source adjusts the current dependent on the current x-ray voltage, however given failures of the x-ray voltage as a result of a tube arcing a predetermined value is set for the current. It is thereby achieved that, after the removal of abruptly ensuing interferences, the coil current exhibits a predetermined value, and thus the current operating state is unambiguously known after the end of the arcing.

In a further embodiment of the invention, at the beginning of the x-ray operation, the current is brought as fast as possible to a sufficiently high value dependent on a measurement of the x-ray voltage. An undesirably long persistence of the electron beam on a spot of the anode, and thus a thermal loading of the anode that is initially too large is prevented. This same concept in accordance with the invention also can be applied at the end of the x-ray operation, by holding the current at a high value during a specific time span, independent of the x-ray voltage. An undesirably long persistence of the abating electron beam is thereby prevented,

DESCRIPTION OF THE PREFERRED EMBODIMENTS

Figure 1:
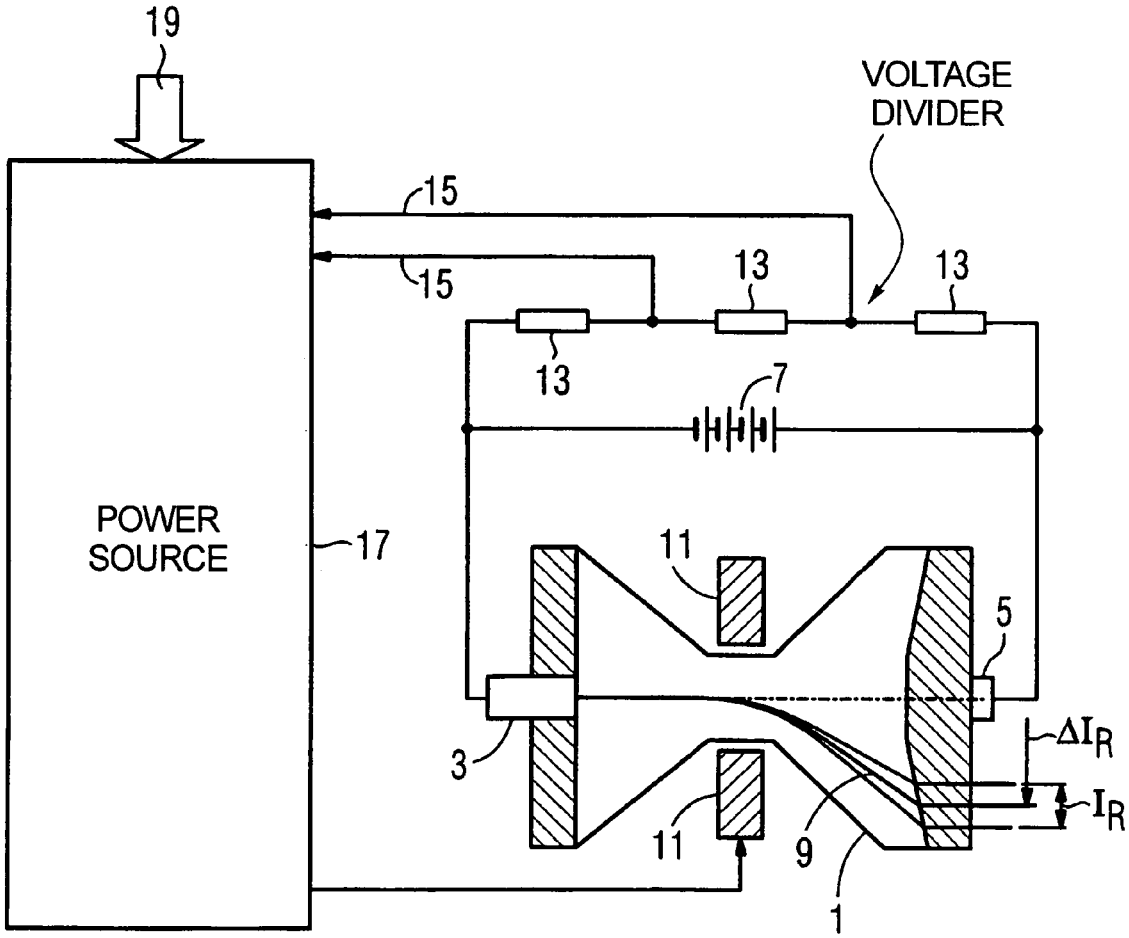
FIG. 1 is a block diagram of a system composed of power source in accordance with the invention, a deflection coil and an x-ray tube.

FIG. 1 shows an overview of a system composed of a power source 17, a deflection coil 11 and an x-ray tube 1. For simplification, the system is shown with only one deflection coil, (one deflection coil pair). To generate more complex focal spot contours and a larger number of focal spot positions, the system can be expanded to use a number of deflection coils 11, each charged with its own coil current.

Electrons are emitted from the cathode 3 of the x-ray tube 1 and are accelerated by the x-ray voltage to the anode 5. The x-ray voltage is generated by the x-ray voltage generator and directly influences the kinetic energy of the electrons, and thus indirectly the characteristic properties of the x-ray radiation generated by the x-ray tube 1. It Is varied depending on the application.

The electrons emitted by the cathode 3 form, within the x-ray tube 1, an electron beam 9 that is schematically shown in FIG. 1. The cathode 3 is designed such that the electron beam 9 is already focused. A further focusing can be achieved if necessary by magnetic fields that are generated by coils arranged around the x-ray tube 1. For this purpose, deflection coils 11 are shown with which the electron beam 9 can be deflected. The focal spot is thereby shifted on the surface of the anode 5. The shifting of the focal spot is dependent on the kinetic energy of the electrons, and thus on the x-ray voltage. Additionally, It Is dependent on the size of the magnetic field generated by the deflection coils 11, and thus on the coil current flowing though the deflection coils 11.

Schematically shown in FIG. 1 is a shifting of the focal spot by a specific amount. This shifting is effected by a coil current $I_R$ that, for this reason, is indicated in the drawing as a spatial measurement for the shifting of the focal spot. In addition to the shifting of the focal spot via the coil current $I_R$, moreover an enlargement of the focal spot is adjusted by a variation of the coil current by a quantity $\Delta I_R$. This enlargement is shown in the drawing as a spatial measurement $\Delta I_R$.

The direction of the electron beam 9 and the position of the focal spot on the anode 5 determine the direction and properties of the x-ray beam generated by the striking electrons. The enlargement of the focal spot additionally causes an enlargement of the generated x-ray beam. These quantities can be selectively influenced by the power source 17.

A signal proportional to the x-ray voltage that is tapped by the x-ray generator 7 via a voltage divider 13 is supplied to the power source 17 via an x-ray voltage input 15. It determines the coil current dependent on this signal. Further regulation data are supplied to the power source 17 via a control data input 19. These regulation data serve, for example, as a specification of a desired focal spot position and focal spot width or contour, depending on the application and x-ray tube type. Using the control data and the x-ray voltage signal, the power source 18 determines a deflection current $I_R$ as well as a deflection current variation $\Delta I_R$ with which it charges the deflection coils 11.

Figure 2:
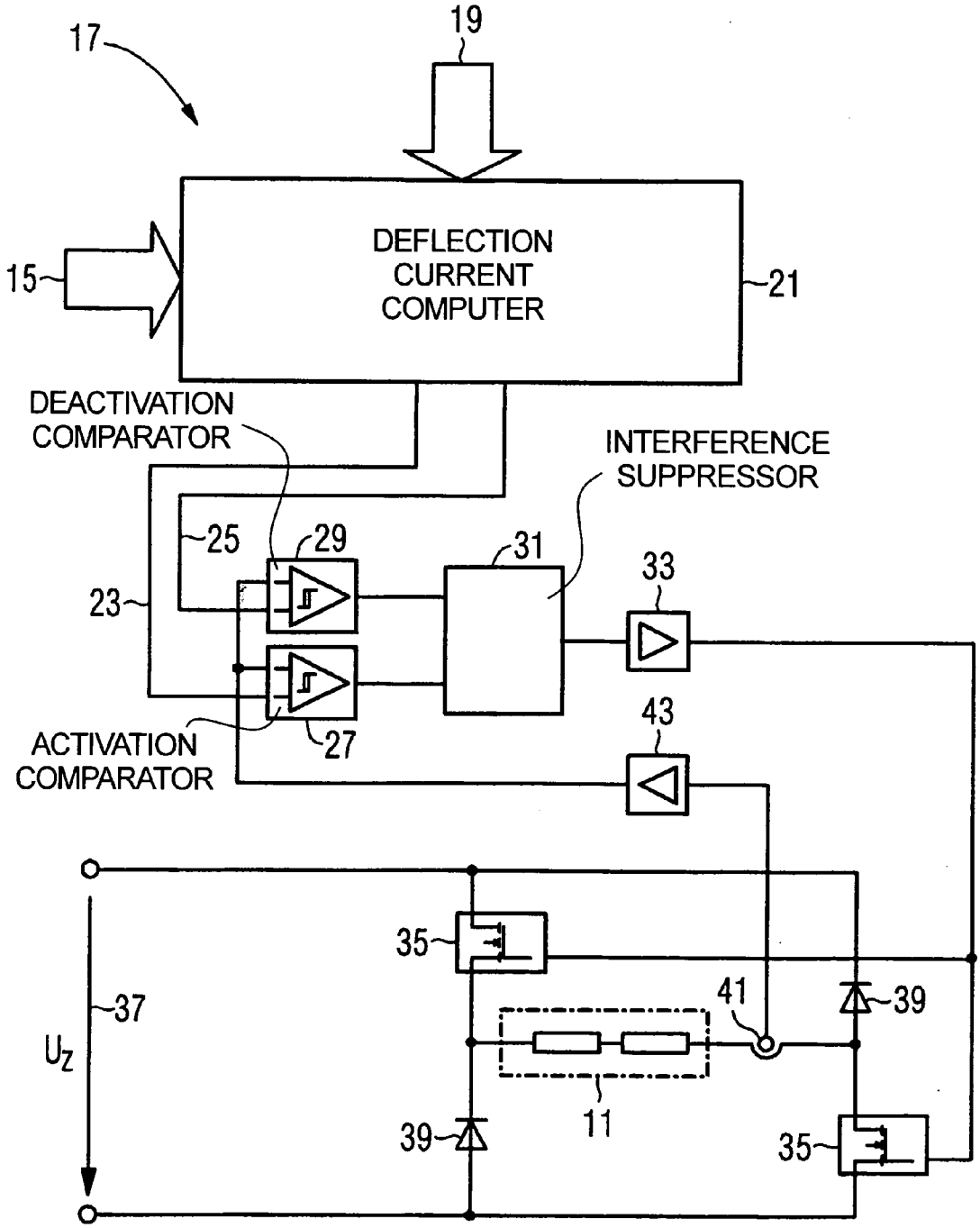
FIG. 2 shows the deflection coil and a power source according to the invention.

FIG. 2 shows the power source 17 in a schematic circuit diagram. Again for simplification, a system with only one deflection coil 11 is shown in FIG. 2.

The regulation data and the x-ray voltage signal are supplied to a deflection current computer 21 via the corresponding inputs 15 and 19. From these input signals, the computer 21 determines the desired focal spot deflection as well as the focal spot expansion or focal spot contour. It generates from this two control signals $I_{max\ 23}$ and $I_{min\ 25}$ as output signals. Both signals are fed to the further circuit and respectively serve as an input signal for a deactivation comparator 27 and an activation comparator 29. Both signals serve to define a minimum and a maximum deflection current, and thus determine the deflection current $I_R$ as well as the deflection current variance $\Delta I_R$. They thus limit and set the focal spot position as well as the focal spot enlargement.

The output signals of the deactivation comparator 27 and the activation comparator 29 are supplied to an interference suppressor 31. In the interference suppressor 31, interference signals at system-typical frequencies are supposed, for example signals with the resonance frequency of the deflection coil 11. The output signal of the interference suppressor 31 is exempt from the system-typical interfering influences and indicates whether the deflection current for deflection coil 11 should be activated or deactivated. For example, the output signal of the activation comparator 29 or, respectively, of the deactivation comparator 27 could show a positive signal edge to activate or, respectively, deactivate the deflection current. The output signal of the interference blanking 31 would then be set by the output signal of the activation comparator 29 and reset by the output signal of the deactivation comparator 27. Depending on the circuit of both comparators 27 and 29, their output signals must be logically associated in a different suitable manner in the interference suppressor 31.

The output signal of the interference suppressor 31 is amplified by an amplifier 33 and serves to activate two power switches 35. If the power switches 35 are closed, the deflection coil 11 is charged with the voltage of the power source 37. The power switches 35, together with the diodes 39, form a bridge circuit 34. The deflection coil 11 has the voltage of the voltage source 37 across it by the arrangement of the power switches 35 and the diodes 39 in the bridge circuit 34.

In place of the diodes 39, other power switches could be used, However, these would have to be specially controlled, which would bring with it a greater circuit complexity, Therefore a version with diodes 39 was chosen in the exemplary embodiment.

If the power switches 35 are open, the deflection coil 11 is connected with the voltage source 37 via the diodes 39, The diodes 39 are connected in the transmission direction and thus apply the voltage −U to the deflection coil 11.

When the power switches 35 are open, the voltage source 11 is applied to the deflection coil 11 via the power switches 35, and it is charged with the voltage +U. The coil current thereby rises in the deflection coil 11 according to the equation dl/dt=U/L.

If the power switches 35 are now closed again, the power source 37 is again applied to the deflection coil 11 via the diodes 39, and the voltage −U is again applied. However, magnetic field energy is still stored in the deflection coil 11, via which the coil current initially continues to flow, in spite of reversal of polarity, and which only decoys with time.

Transistors that operate in switched operation are used as the power switches 35. In this operating manner, only minimal power losses ensue. The current rise and fall in the deflection coil 11 is, according to the equation dl/dt=U/L, dependent only on the voltage of the voltage source 37 and on the element value of the deflection coil. Both of these quantities thus determine how fast the deflection current can be adjusted in order to adapt the deflection of the electron beam, for example to rapid changes of the x-ray voltage.

At a current tap 41, the signal proportional to the coil current flowing through the deflection coil is tapped. It is amplified by an amplifier 43 and supplied to the activation comparator 27 as well as to the deactivation comparator 29. The current regulation circuit is thereby closed, since the regulation variable is supplied directly to both comparators with the coil current, Dependent on the amount of the coil current, both comparators regulate the circuit time for the coil current as a regulation parameter. The regulation circuit represents a two-point regulator in which the maximum current $I_{max}$ as well as the minimum current $I_{min}$ are given as desired values, between which the measured coil current oscillates.

An overshoot of the regulation variable, (the deflection current) is not possible, since the power switches 35 are switched over upon reaching the current limits $I_{min}$ and $I_{max}$. The deflection current thus never can exit the target range. Interfering influences, such as current pulses due to coil resonances given the switching, are eliminated to prevent an intensification based on positive feedback of the control circuit via the interference suppressor 31.

The precision of the regulation is limited only by the precision of the current measurement via current tap 41 and by the speed of the circuit times via the power switches 35. The regulation precision is thus valid for the coil current variance $\Delta I_R$ as well as for the coil current average value $I_R$.

Moreover, the control data for the deflection current computer 21, in addition to focal spot positions and contours, can include data to compensate [balance] manufacturing tolerances and for different types of x-ray tubes. Typical problems effects for x-ray tubes such as, for example, damage to the anode disc due to excessive loading, already can be eliminated by disturbance variable compensation in the stored desired values.

The regulation offers the typical advantages for regulations that automatically compensate an interfering influence. A further advantage of the specified regulation is that, due to the direct causal connection between the deflection current, the deflection of the electron beam and the focal spot position, the focal spot position is substantially directly predetermined with the coil current as a regulation variable. The desired values of the regulation variable thus are directly linked with the focal spot properties that are of actual interest.

The desired values for the two-point regulator are calculated by the deflection current computer 21 from the measured x-ray voltage. Different one-dimensional focal spot positions and widths can be stored in and recalled from the deflection current computer 21. The shown one-channel regulation can be expanded without difficulty to multi-channel regulation, by the control computer calculating, for each further regulation channel, its own desired values for maximum and minimum current that are respectively supplied to a further regulation circuit for a further deflection coil. Via a multi-channel regulation, it is possible not only to provide the one-dimensional focal spot position as well as the focal spot enlargement, but rather also various two-dimensional positions and contours. These can likewise be stored in and recalled from the deflection current computer 21.

As the case may be, the channels must be temporally tuned to one another. Due to the correlation cited above for the steepness of the current rise and fall (dl/dt=U/L), a synchronization can ensue, for example using the control of the voltage of the voltage source 37.

The deflection current computer 21 contains a special program for the beginning of the x-ray operation. Time delays of the deflection upon activation lead to extreme heating and melting in the middle of the anode 5, due to the persistence of the as-of-yet undeflected electron beam. Upon activation, the deflection current computer 21 therefore initially provides a desired value for the deflection current, independent of the x-ray voltage, to which the coil current quickly rises at the beginning. As soon as a maximum as well as minimum coil current value (calculated by the deflection current computer 21 dependent on the x-ray voltage) are present, they are supplied as desired values. Activation delays of the x-ray voltage or sampling times or calculation times thus are avoided.

The deflection current computer 21 furthermore contains a special deactivation program, As a rule, after disconnection the x-ray voltage decays exponentially, but in any case extremely fast, Since the deflection current decays slower, as a result of the final current steepness dl/dt given by the arrangement, without a deactivation program the danger exists that the electron beam would, if uncontrolled, strike a wrong location and would damage the tube due to the high thermal loads. The disconnection program ensures that the decaying electron beam furthermore moves over the anode 5 with a high speed.

Moreover, the deflection current computer 21 contains a special program to react to failures in the x-ray voltage. Such failures ensue from time to time as a result of arcings in the x-ray tube 1. If the deflection current were also to be calculated given such arcings, dependent on the x-ray voltage, this would result in an interruption of the deflection of the electron beam. In order to prevent this, in the cause of rapidly occurring discontinuities in the x-ray voltage, predetermined desired values are used for the minimum and maximum coil current. After arcings in the x-ray tube 1, the focal spot is therefore directly dependent on the desired position, and not approximately dependent on sampling times in the high-voltage measurement of the x-ray voltage. Given rapid interruptions of the x-ray voltage, defined predetermined values can be used as deflection current desired values, however the values used directly prior to the occurrence of the voltage interruption can also be used.

Figure 3:
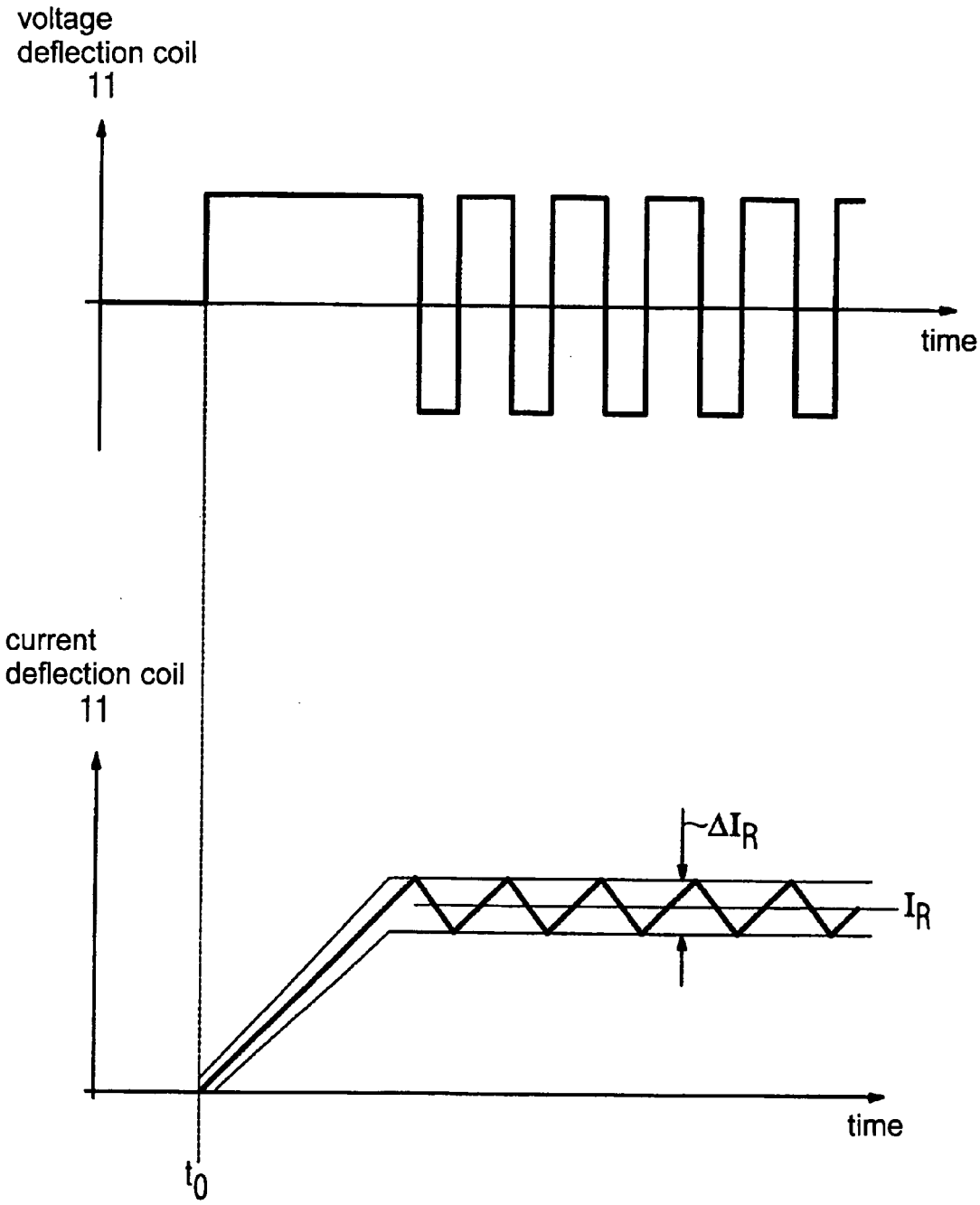
FIG. 3 illustrates the coil voltage and the coil current of the power source according to the invention.

FIG. 3 shows the time curve of the voltage and of the current at the deflection coil 11 that set via the regulation shown in FIG. 2. A special activation program of the deflection current computer 21 is not considered In the shown voltage and current curve. The x-ray voltage is activated at the point in time $T_0$. Upon activation, a maximum value for the deflection current $I_{max}$ and a minimum value $I_{min}$ are calculated dependent on the x-ray voltage and given to the control circuit. In the control circuit, the power switches 35 are thereupon opened and the deflection coil 11 thereby reverses polarity from the voltage 0V to the voltage +U. The deflection current is thereby set by the deflection coil 11, and rises according to the equation dI/dt=U/L until it reaches the desired value for the maximum deflection current $I_{max}$. As soon as $I_{max}$ is achieved, the power switches 35 are opened. The voltage +U is thereby no longer applied to the deflection coil 11, but rather −U. After switching over the voltage at the deflection coil 11, the coil current sinks with the same temporal constant as in the rise, until it achieves the minimum desired value $I_{min}$. Upon reaching $I_{min}$, the power switches 35 are again closed, and the voltage +U is again applied to the deflection coil 11. The coil current thereby increases again up to the desired value $I_{max}$, upon reaching which the power switches 35 are opened again. This process is cyclically repeated.

The shown voltage and current curves at the deflection coil 11 occur regardless of the maximum and minimum current values, exclusive of the regulation circuit. The triangular current modulation is optimally suited for deflection of the electron beam of an x-ray tube 1, since the entire focal spot width is thereby scanned with uniform intensity and speed, In contrast to this, for example, a sine-shaped oscillation effects a slow change of the deflection of the electron beam at the boundary regions, as well as a rapid change in the middle region. The generated x-ray beam as well as the thermal load of the node 5 would then be inhomogeneous.

The frequency of the oscillation of the deflection current is dependent on the minimum and maximum desired value $I_{min}$ and $I_{max}$ via the temporal constant given rise and fall of the coil current. The temporal constant in turn is dependent on the inductance of the deflection coil 11 as well as on the voltage applied to the coil. This voltage can be predetermined by the deflection current computer 21 in order to influence the frequency of the oscillation of the deflection current. In the event that it is necessary, a specific frequency can be predetermined and, as the case may be, also regulated by the deflection current computer 21.

Although modifications and changes may be suggested by those skilled in the art, it is the intention of the inventor to embody within the patent warranted hereon all changes and modifications as reasonably and properly come within the scope of his contribution to the art.

I claim as my invention:

1. An X-ray device comprising:

an X-ray tube having a cathode, that emits an electron beam, and an anode on which said electron beam is incident, and a deflection coil disposed to interact with said electron beam in a propagation path between said cathode and said anode, said deflection coil having two terminals; and a power source comprising a voltage source having opposite poles, a bridge circuit having terminals respectively connected to the two terminals of the deflection coil each via one power switch, said power switch connecting said deflection coil terminals in series with the opposite poles of the voltage source, a current tap that taps a coil current signal proportional to a current through the deflection coil, an activation comparator connected to said current tap supplied with an activation current signal, a deactivation comparator connected to said current tap and supplied with a deactivation current signal, and said activation comparator and said deactivation comparator closing the power switches if said coil current undershoots said activation current signal and opening said power switches if said coil current signal overshoots said deactivation current signal.

2. An X-ray device as claimed in claim 1 wherein said bridge circuit comprises diodes respectively adapted for connection to the terminals of said deflection coil in series with an opposite pole of said voltage source, with one power switch connected therebetween.

3. An X-ray device as claimed in claim 1 comprising an interference suppressor, connected to said activation comparator and to said deactivation comparator, for suppressing interference signals at frequencies corresponding to a resonant frequency of the deflection coil, to eliminate interferences in signals for switching said power switches.

4. An X-ray device as claimed in claim 1 comprising a deflection current computer that generates said activation current signal and said deactivation current signal dependent on at least one of an X-ray voltage of said X-ray tube, a type of said X-ray tube, manufacturing tolerances of said X-ray tube, aging of said X-ray tube, and known, recurring interfering influences arising during operation of said X-ray tube.

5. An X-ray device as claimed in claim 4 wherein said deflection current computer generates a predetermined activation current signal and a predetermined deactivation current signal upon detection of an abrupt discontinuity of said X-ray voltage.

6. An X-ray device as claimed in claim 4 wherein said deflection current computer generates at least one of said deactivation current signal and said activation current signal independent of the X-ray voltage upon a start of operation of said X-ray tube.

7. An X-ray device as claimed in claim 4 wherein said deflection current computer generates at least one of said deactivation current signal and said activation current signal independent of the X-ray voltage upon a end of operation of said X-ray tube.

* * * * *